US007156146B2

(12) United States Patent
Schäfer et al.

(10) Patent No.: US 7,156,146 B2
(45) Date of Patent: Jan. 2, 2007

(54) FEEDER INSERT HAVING PROTECTIVE CAP

(75) Inventors: Jürgen-Michael Schäfer, Köln (DE); Thomas-Michael Schäfer, Köln (DE)

(73) Assignee: GTP-Schafer Giesstechnishe Produkte GmbH (DE)

( * ) Notice: Subject to any disclaimer, the term of this patent is extended or adjusted under 35 U.S.C. 154(b) by 109 days.

(21) Appl. No.: 10/496,448

(22) PCT Filed: Nov. 19, 2002

(86) PCT No.: PCT/EP02/12925

§ 371 (c)(1),
(2), (4) Date: May 20, 2004

(87) PCT Pub. No.: WO03/043761

PCT Pub. Date: May 30, 2003

(65) Prior Publication Data

US 2004/0256075 A1 Dec. 23, 2004

(30) Foreign Application Priority Data

Nov. 20, 2001 (DE) ..... 101 56 571

(51) Int. Cl.
*B22C 9/08* (2006.01)

(52) U.S. Cl. ..... 164/359; 164/360; 164/351

(58) Field of Classification Search ..... 164/359, 164/360, 351

See application file for complete search history.

(56) References Cited

U.S. PATENT DOCUMENTS 3,815,665 A * 6/1974 Baur ..... 164/359
3,923,526 A * 12/1975 Takashima ..... 106/38.22
5,291,938 A * 3/1994 Metevelis et al. ..... 164/359

FOREIGN PATENT DOCUMENTS

| | | | |
|---|---|---|---|
| DE | 15 19 320 | | 6/1942 |
| DE | 29 28 166 | | 1/1981 |
| DE | 41 19 192 | | 12/1992 |
| DE | 4119192 | * | 12/1992 |
| DE | 19503456 | * | 11/1995 |
| DE | 196 42 838 | | 7/1997 |
| DE | 10039519 | * | 2/2002 |

* cited by examiner

*Primary Examiner*—Jonathan Johnson
*Assistant Examiner*—Ing-Hour Lin
(74) *Attorney, Agent, or Firm*—Robert W Becker & Associates; Robert W Becker

(57) ABSTRACT

A feeder insert is provided for a mold utilized for pouring metal. The insert includes a feeder body having a feed volume, in the form of an inner space, delimited by side walls and a top portion. A feed opening is provided in the base region for communicating with a hollow mold space. A domed feeder cap is displaceably disposed on a feeder body, surrounds the side walls of the feeder body to form an insulating gap, and is fixed in position relative to the feeder body prior to molding of the insert. At least one spacer of flexible material is disposed between the top portions of the feeder body and feeder cap such that during molding of the insert, and placement of the feeder body on the mold surface, due to molding pressure that occurs the feeder cap is displaceable relative to the feeder body while leaving an insulating gap between the top portions of the feeder body and feeder cap.

12 Claims, 1 Drawing Sheet

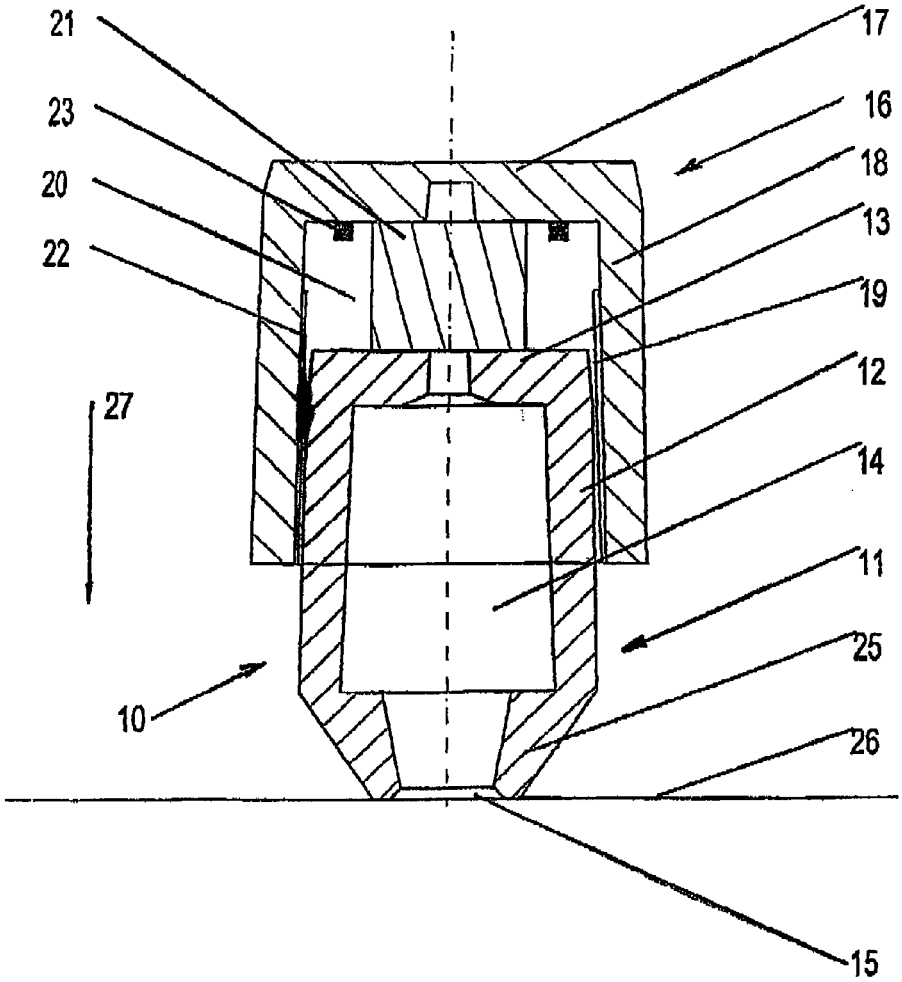
21
23
20
22
27
10
17
16
18
13
19
12
14
11
25
26
15

FEEDER INSERT HAVING PROTECTIVE CAP

BACKGROUND OF THE INVENTION

The invention relates to a feeder insert for use in a mold utilized during pouring of metals, with a feeder body made of an exothermic and/or insulating material and having a feed volume, whereby the feed body is provided with an inner space, as the feed volume, delimited by side walls and a top portion, and in the base region of the feeder body a feed opening is formed as a communication to the hollow mold space.

A feeder insert having the aforementioned features is described in DE 196 42 838 A1. The feeder body, which has a closed inner space in its top portion, as a feed volume, can be placed, during the molding, upon the mold surface of the mold. During the molding of the feeder insert, the problem exists that the molding pressure, which acts upon the mold sand, and hence also upon the feeder body, can lead to damage of the feeder body.

To eliminate this problem, the company Chemex GmbH Has proposed and used a feeder insert, designated "telescopic feeder", according to which the feeder body is comprised of two components that are displaceable relative to one another and together form the feed volume. In this connection, the lower portion of the feeder body, which can be placed upon the mold surface, is open at the top and is spanned from above by a second, bell-shaped part of the feeder body, whereby when molding pressure occurs the parts are pushed into one another and for this purpose the outer diameter of the lower part, and the inner diameter of the upper, bell-shaped part, must be coordinated with one another in an exactly fitting manner.

The feeder insert, which has become known through use, has the drawback that the fines or rubbed-off material that results when the upper and lower parts of the feeder inserts are pushed into one another can fall into the feed volume and when the mold is poured off can come into contact with the liquid metal, so that impurities in the molten metal can result. A further drawback is that the exact size of the feed volume of the molded feeder insert defined by the two parts of the feeder insert is determined by the extent to which the upper and lower parts of the feeder insert are pushed into one another, so that no reliable statement about the size of the feed volume of the molded feeder insert can be made. This makes the design of the insert, and the selection of the size of the necessary feeder insert, difficult.

It is therefore an object of the present invention to improve a feeder insert having the aforementioned features in such a way that despite maintaining a uniform, closed feed volume in the interior of the feeder insert, protection of the feeder insert against the effect of molding pressure is provided.

SUMMARY OF THE INVENTION

The basic concept of the invention is that a domed feeder cap is displaceably disposed on the feeder body and surrounds the outer wall of the feeder body such that an insulating gap is formed, wherein prior to the molding of the feeder insert the feeder cap is fixed in position relative to the feeder body, and that at least one spacer, which is made of a flexible resilient material, is disposed between the top portion of the feeder body and the top of the feeder cap in such a way that during the molding of the feeder insert, and placement of the feeder body upon the mold surface, due to the molding pressure that occurs the feeder cap is displaceable relative to the feeder body while leaving an insulating gap between the top portions of the feeder cap and feeder body.

The invention thus reverts to the principle of using a second feeder body in the form of a domed feeder cap as protection for the feeder body that during the molding is upright of the mold surface. The overall thermotechnical balance of the feeder insert is improved due to the fact that appropriate measures ensure that even when the feeder cap is pushed in there results or remains between the side walls of the feeder cap and feeder body, as well as between the top portions, a respective insulating gap. Prior to the molding, the feeder body and feeder cap are fixed in position relative to one another in any suitable manner, for example via spots of adhesion, resulting in a simple handling of the feeder insert during its molding. Due to the molding pressure that occurs, the points of adhesion are released, and the feeder cap can yield to the effect of the molding pressure and can be displaced relative to the feeder body that is standing on the mold surface. Since as before the feed volume is disposed within the feeder body, and can be closed off relative to the feeder cap, any worn off material that might result cannot enter the feed volume, and the size of the feed volume is fixed by the selection of the feeder body.

The invention has the particular advantage that the known feeder body is now protected against the molding pressure that occurs during the molding. A further advantage is that standardized components can be used for manufacturing the inventive feeder insert; thus, the additionally provided feeder caps are also known and in existence, and they require only slight modification in order to use them in the inventive manner.

Pursuant to embodiments of the invention, the spacer that is provided between the top portion of the feeder body and the top of the feeder cap can be made of polystyrene material, which yields under the effect of molding pressure, and which is seated in the gap between the feeder cap and feeder body, which gap becomes smaller as the pushing-in increases, so that an insulating effect results. Alternatively, a spring element can be provided as a spacer, and finally, the spacer can be made of an insulating material that, under the effect of the molding pressure, effects the insulating gap between. The top portion of the feeder body and the top of the feeder cap.

So that the desired insulating gap between the top portion of the feeder body and the top of the feeder cap remains at the end of the push-in stroke, a stop can be provided on the feeder cap or on the feeder body to limit the push-in stroke of the feeder cap on the feeder body.

Since during the placement of the feeder cap on the feeder body, the insulating gap that is provided between the side walls of the feeder cap and of the feeder body is to be maintained, pursuant to another embodiment appropriate guide structures are provided. These guide structures can comprise guide strips formed on the feeder body or on the feeder cap that expediently have a triangular shape, so that the apexes of the guide strips glide on the respectively oppositely disposed component.

Alternatively, the side walls of the feeder body and/or feeder cap can be provided with wave-shaped protrusions as a guide structure.

Pursuant to one embodiment of the invention, the feeder cap is made of an insulating material.

However, the feeder cap can also comprise an exothermic material that despite the provision of the insulating gap is flammable by radiation, as a result of which the thermal balance of the feeder insert can on the whole be improved.

Pursuant to another embodiment of the invention, Williams strips can be disposed on the inner surface of the side walls of the feeder body, which strips, in the longitudinal direction of the feeder body, project into the feed volume.

BRIEF DESCRIPTION OF THE DRAWINGS

Shown in the drawing is one embodiment of the invention, which will be described subsequently. The sole FIGURE shows, in a cross-sectional side view, a feeder insert having a feeder body onto which can be placed a feeder cap.

DESCRIPTION OF SPECIFIC EMBODIMENTS

The feeder element or insert shown in the drawing comprises a known feeder body 11, the side walls 12 and cover or top portion 13 of which surround an inner space as the feed volume 14. A feed opening 15 is formed in the base region 25 of the feeder body 11 that adjoins the side walls 12. During molding of the feeder insert 10, the feeder body 11 is placed upon a mold surface 26 of a pertaining mold.

The feeder body 11 is spanned by a hat-shaped or domed feeder cap 16 having a cover or top 17 and side walls 18, whereby the feeder cap 16, via at least one spacer 21 made of a flexible material, is kept spaced from the feeder body 11 in such a way that upon the effect of molding pressure in the direction of the arrow 27, the feeder cap 16 can yield to the molding pressure and can be displaced relative to the stationary feeder body 11.

The dimensions of the feeder cap 16 are selected relative to the feeder body 11 in such a way that the side walls 18 of the feeder cap 16 maintain a spacing from the side walls 12 of the feeder body 11 and thus form an insulating gap 19. So that during the push-in movement of the feeder cap 16 relative to the feeder body 11 this insulating gap 19 is maintained, a plurality of guide structures 22 are provided that are preferably distributed over the periphery of the feeder body. These guide structures can, for example, comprise guide strips that extend in the longitudinal direction of the feeder body 11 and feeder cap 16 and are mounted on the respective side walls 12 and 18; if the guide strips have a triangular shape, their apexes glide on the respectively other component. It is to be understood that other configurations are also possible, for example elevations applied in a point-type manner as guide structures. It is also possible to provide the side walls 12, 18 of the feeder body 11 and feeder cap 16 with appropriate wave-shaped elevations, either individually or in cooperation with one another.

Since after the push-in of the feeder cap 16 an insulating gap 20 is to also remain between the top portion 13 of the feeder body 11 and the top 17 of the feeder cap 16, one or more stops 23 can be provided on the top 17 of the feeder cap 16 and/or on the top portion 13 of the feeder body 11.

The features of the subject matter of these particulars disclosed in the preceding specification, the patent claims, the abstract and the drawing can be important either individually or also in any combination with one another for realizing the various embodiments of the invention.

The specification incorporates by reference the disclosure of German priority document 101 56 571.2 filed Nov. 20, 2001 and PCT/EP02/12925 filed Nov. 19, 2002.

The present invention is, of course, in no way restricted to the specific disclosure of the specification and drawings, but also encompasses any modifications within the scope of the appended claims.

The invention claimed is:

1. A feeder insert for use in a mold utilized for pouring metal, comprising:

a feeder body having a feed volume in the form of an inner space that is delimited by side walls and a top portion, wherein a base region of said feeder body is provided with a feed opening for communication with a hollow mold space;

a domed feeder cap displaceably disposed on said feeder body, wherein said feeder cap surrounds said side walls of said feeder body such that an insulating gap is formed between said feeder cap and said side walls, wherein prior to a molding of said feeder insert said feeder cap is fixed in position relative to said feeder body; and at least one spacer of a flexible material disposed between said top portion of said feeder body and a top of said feeder cap such that during a molding of said feeder insert and a placement of said feeder body upon a mold surface, due to molding pressure that occurs said feeder cap is displaceable relative to said feeder body while leaving an insulating gap between said top portion of said feeder body and said top of said feeder cap.

2. A feeder insert according to claim 1, wherein said at least one spacer is made of polystyrene.

3. A feeder insert according to claim 1, wherein a spring element is provided as said at least one spacer.

4. A feeder insert according to claim 1, wherein said at least one spacer is made of an insulating material that under the effect of molding pressure effects said insulating gap between said top portion of said feeder body and said top of said feeder cap.

5. A feeder insert according to claim 1, wherein to limit a push-in stroke of said feeder cap on said feeder body, at least one stop is provided on said feeder cap or said feeder body.

6. A feeder insert according to claim 1, wherein to maintain said insulating gap between said feeder cap and said side walls of said feeder body during a placement of said feeder cap on said feeder body, guide structures are provided between side walls of said feeder body and said feeder cap respectively.

7. A feeder insert according to claim 6, wherein said guide structures comprise guide strips formed on said feeder body or on said feeder cap.

8. A feeder insert according to claim 7, wherein said guide strips have a triangular shape such that apexes of said guide strips glide on an oppositely disposed component.

9. A feeder insert according to claim 6, wherein side walls of at least one of said feeder body and said feeder cap are provided with wave-shaped protrusions as said guide structures.

10. A feeder insert according to claim 1, wherein said feeder cap is made of an insulating material.

11. A feeder insert according to claim 1, wherein said feeder cap is made of an exothermic material.

12. A feeder insert according to claim 1, wherein disposed on inner surfaces of said side walls of said feeder body, in a longitudinal direction of said feeder body, are Williams strips that project into said feed volume.

* * * * *